US005664430A

United States Patent [19]

Karman

[11] Patent Number: 5,664,430

[45] Date of Patent: Sep. 9, 1997

[54] REMOVABLE CONDENSATE PAN

[75] Inventor: Raul B. Karman, Key Biscayne, Fla.

[73] Assignee: Carrier Corporation, Syracuse, N.Y.

[21] Appl. No.: 762,646

[22] Filed: Dec. 9, 1996

[51] Int. Cl.[6] ..... F25D 21/14

[52] U.S. Cl. ..... 62/285; 62/291

[58] Field of Search ..... 62/272, 259.2, 62/285, 286, 288, 291

[56] References Cited

U.S. PATENT DOCUMENTS

| | | | |
|---|---|---|---|
| 1,872,728 | 8/1932 | Gloekler | 62/286 |
| 3,691,786 | 9/1972 | Anderson et al. | 62/279 |
| 5,105,630 | 4/1992 | Kim | 62/285 |
| 5,174,467 | 12/1992 | Sullivan | 220/571 |

FOREIGN PATENT DOCUMENTS

| | | | |
|---|---|---|---|
| 299636 | 12/1987 | Japan | 62/285 |

*Primary Examiner*—William Doerrler

[57] ABSTRACT

An air handling unit has a condensate pan which is removably disposed in an opening below the cooling coil. A pair of parallel u-shaped channels have coil support members transversely disposed thereon to support the cooling coil thereabove while slideably receiving the condensate pan therebetween. Sloped tracks are installed between the respective legs of the u-shaped channels, and the condensate pan is correspondingly tapered such that when it is placed in the installed position, its bottom is sloped downwardly toward a drain line.

6 Claims, 3 Drawing Sheets

REMOVABLE CONDENSATE PAN

BACKGROUND OF THE INVENTION

This invention relates generally to air conditioning systems and, more particularly, to a condensate collection apparatus for use with an evaporator coil.

A cooling or evaporator coil of an air conditioning system has a tendency for condensate to collect on its surface because the air flowing over the coil is cooled below its dew point, especially during periods and in localities in which the humidity level is high. It is therefore necessary to place a condensate pan under the coil and provide for drainage of the condensate that collects in the pan.

One type of such an air conditioning unit is referred to as an air handling unit. It is a relatively large unit located on the roof of the building or in a special containment room, and includes, among other things, a blower, filters, and a cooling coil through which air is passed. The associated condensate pan is normally solidly attached to the air handling unit structure by welding or the like.

Although efforts are made to drain water from the pan as it collects, water is always present in the pan during operation of the air handling unit, and some water always remains when the unit is shut off. As a result, the condensate pan is normally the dirtiest part of the system since it accumulates dirt from the air that is washed down by the condensed water. Accordingly, it becomes a perfect breeding ground for algae and other microorganisms, and it is therefore necessary to periodically clean and disinfect the pan. This is difficult because, in order to minimize the overall height of the unit, there is a minimum of space provided between the cooling coil and the pan.

In addition to the algae problem, a condensate pan is very susceptible to rusting because of the constant presence of water therein. If the pan does rust out, replacement is very difficult since, in many designs, the pan supports the cooling coils and other components. Therefore, both the unit casing and these components must be removed in order to remove the pan for replacement. Further, removal of the pan usually requires disconnection, and possibly a cutting free, of the pan from the frame of the unit. Recognizing the removal difficulty, all manufacturers now offer stainless steel pans as options, but these are expensive and still do not solve the problem of algae growth and accumulation of dirt.

It is therefore an object of the present invention to provide an improved method and apparatus for drainage of condensate from an air handling unit.

Another object of the present invention is the provision for ease in periodic cleaning of a condensate pan in an air handling unit.

Yet another object of the present invention is the provision in an air handling unit for a condensate pan that can be easily removed and/or replaced.

Still another object of the present invention is the provision in an air handling unit for a condensate drainage apparatus which is economical and practical in use.

These objects and other features and advantages become more readily apparent upon reference to the following description when taken in conjunction with the appended drawings.

SUMMARY OF THE INVENTION

Briefly, in accordance with one aspect of the invention, provision is made for a condensate pan which can be easily removed from an air handling unit for purposes of cleaning and/or replacement. This is accomplished with a support structure which independently supports the cooling coil while allowing the condensate pan to be slideably removed from a space below. Access to the pan is gained by way of an access door in the side of the unit.

By another aspect of the invention, a pair of spaced u-shaped support members have coil support members transversely extending thereacross to support the cooling coil above. Between the legs of the u-shaped channels, a track is disposed for slideably receiving the condensate pan thereon. The track is preferably sloped, and the pan is correspondingly tapered such that the floor of the pan is sloped to facilitate drainage.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
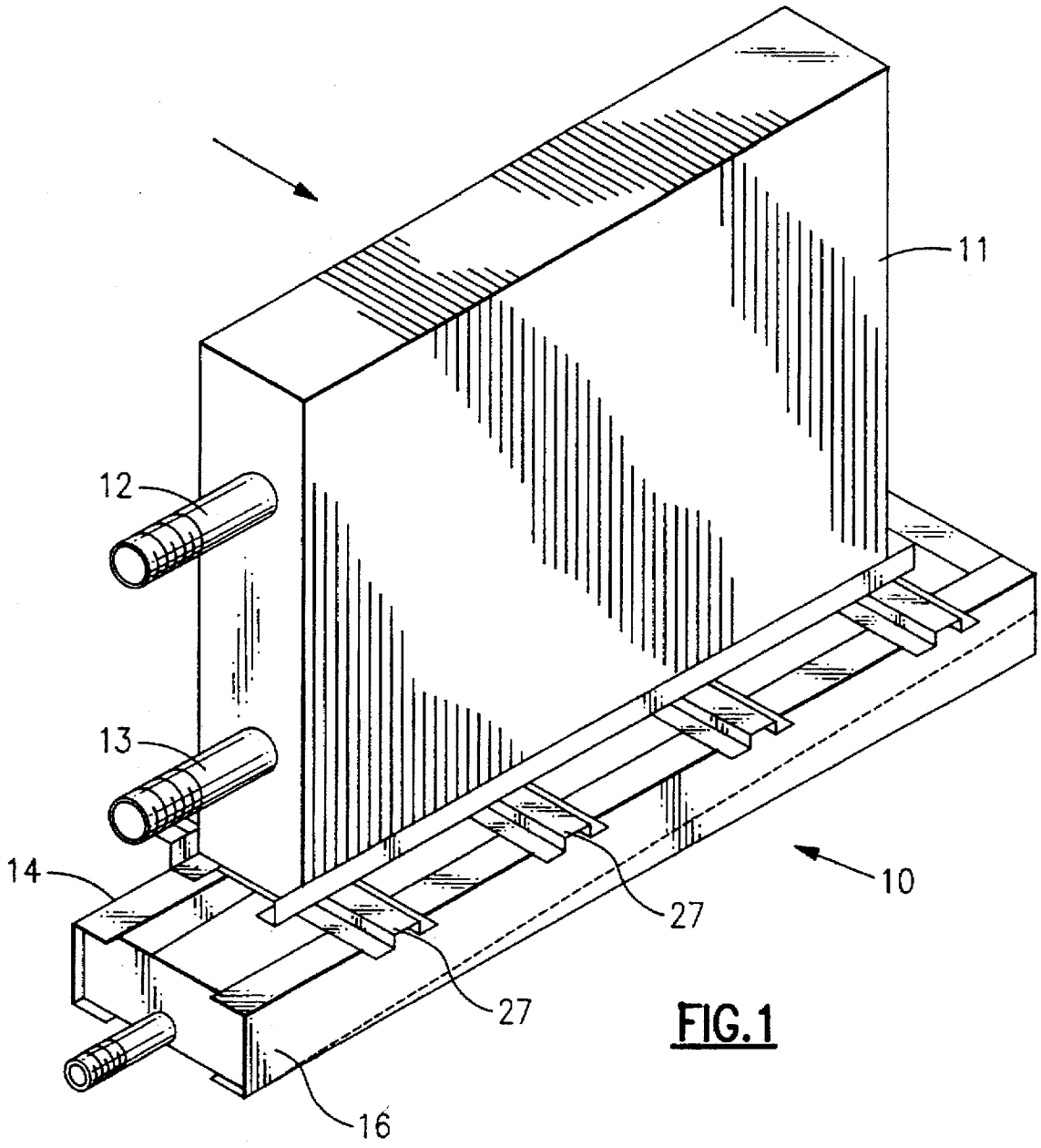
FIG. 1 is a perspective view of an air handling unit cooling coil with the present invention disposed therebelow.

Referring now to FIG. 1, the invention is shown generally at 10 as applied to a cooling coil 11 of an air handling unit (not shown). The cooling coil 11 has an inlet 12 for the flow of refrigerant or other cooing substance therein, and an outlet 13 for the flow of refrigerant or other cooling substance to be passed to the compressor (not shown). The air to be cooled by the coil 11 is made to flow in the direction indicated by the arrow by a blower or a fan which may be either upstream in a blow-through arrangement, or downstream in a draw-through arrangement.

Figure 2:
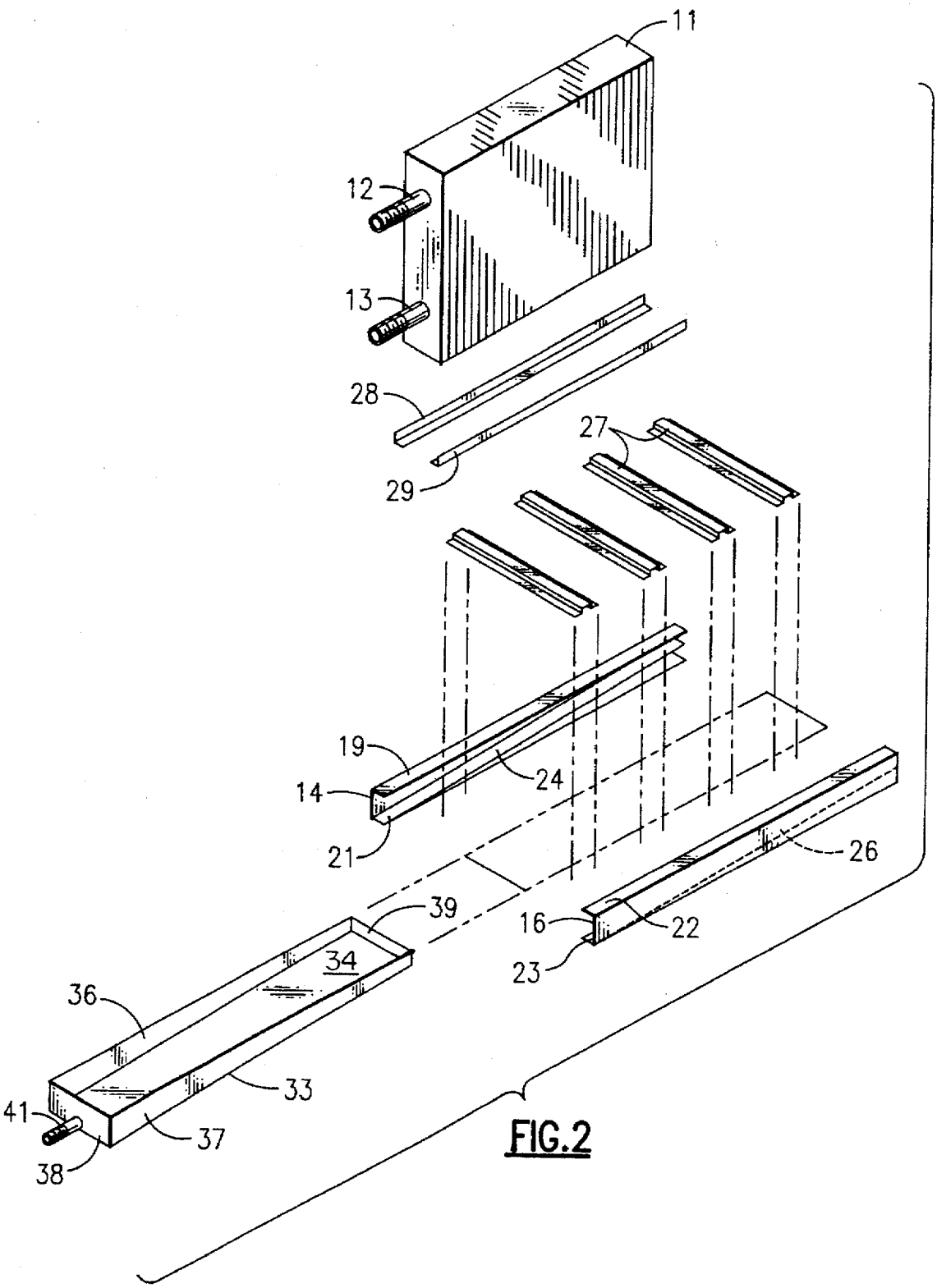
FIG. 2 is an exploded view thereof.

Referring now to FIGS. 1–4, the structural components of the present invention will now be described. A pair of u-shaped channels 14 and 16 are placed on a floor member 17 of the unit frame 18 (see FIG. 4). Channel 14 has parallel legs 19 and 21, and channel 16 has parallel legs 22 and 23. Between the legs of the respective channels 14 and 16 are respective track members 24 and 26, which at one end thereof, referred to as the front end, are coincident with the lower leg, and at the other end thereof are sloped upwardly toward the rear end thereof, as shown in FIG. 2.

Placed on and supported by the u-shaped channels 14 and 16 are a plurality of coil support members 27 which are preferably formed of a u-shaped, metal material for purposes of strength. The weight of the coil 11 rests on the coil support members 27, but with a pair of angled coil sliding channels 28 and 29 therebetween. The coil sliding channels 28 and 29 fit around the lower edges of the front and rear sides of the coil 11 and serve the purpose of sliding the coil out of the air handling unit if and when the cooling coil needs to be repaired or replaced.

Figure 4:
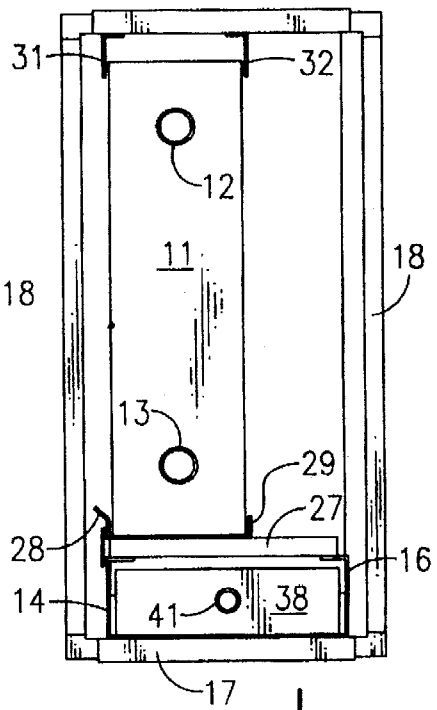
FIG. 4 is a side elevational view thereof as seen along lines 4—4 of FIG. 3.
Figure 3:
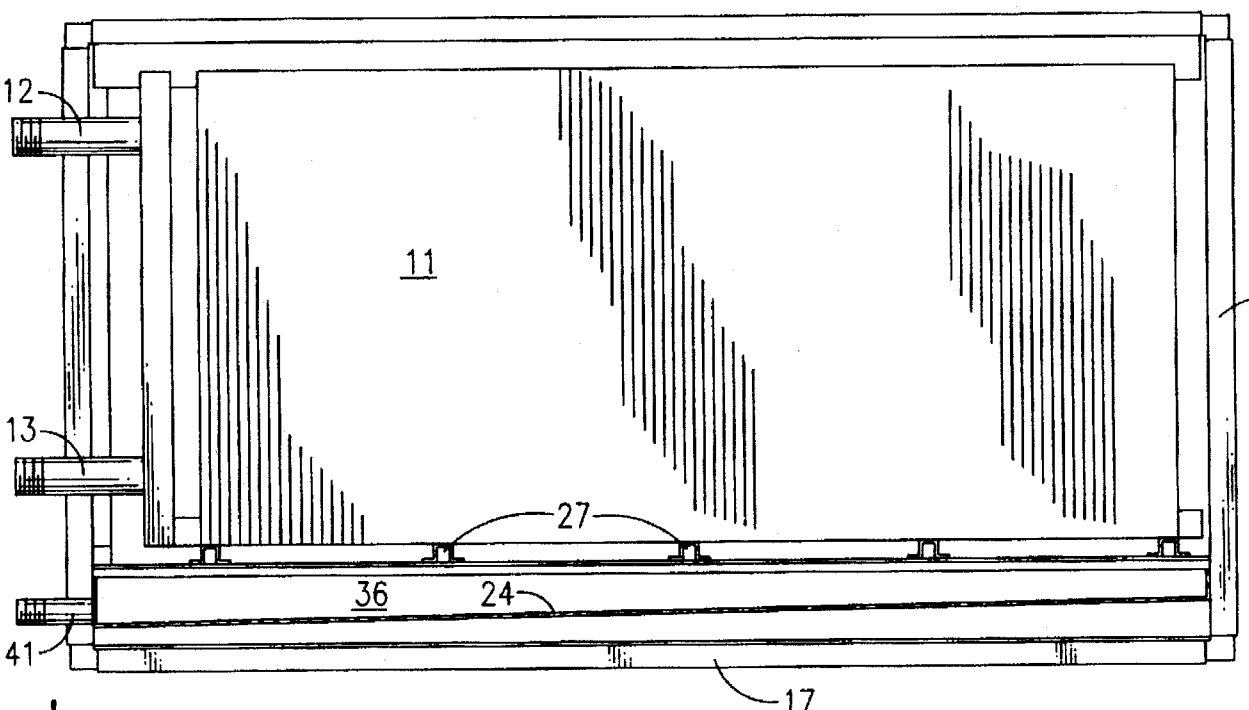
FIG. 3 is a front or end elevational view thereof as seen along lines 3—3 of FIG. 4.

Similar channels 31 and 32 are disposed at the upper edge of the coil 11 for purposes of placement and retention (see FIG. 4).

A condensate pan 33 is provided, having a bottom 34, sidewalls 36 and 37, and front and rear end walls 38 and 39. A drain line 41 is provided in a lower portion of the front end wall 38. As will be seen, the condensate pan 33 is tapered from front to rear such that when the pan is in the installed position, it will slope downwardly toward the drain line 41 to facilitate more complete drainage. The pan 33 is installed between the two channels 24 and 26 with the lower surface thereof slideably resting on the tracks 24 and 26. Thus, the condensate pan 33 can easily be removed from the system by disconnecting a union outside of the air handling unit to disconnect the drain line 41, opening an access door near the front end wall 38 and sliding the condensate pan 33 out of the opening. After cleaning, the pan can be easily replaced by sliding it back into its position between the channels, closing the access door and reconnecting the drain line 41.

Although this invention has been shown and described with respect to a preferred embodiment, it will be understood to those skilled in the art that various changes in the form and detail thereof may be made without departing from the true spirit and scope of the claimed invention. For example, although the invention has been described in terms of use with an air handling unit, it can just as well be used with either air conditioning units such as fan coils and room air conditioners.

What is claimed is:

1. In an air conditioning system of the type having an evaporator coil which is susceptible to the formation of condensate thereon, an improved condensate collecting apparatus comprising:

a pair of u-shaped channels disposed in parallel relationship with their open ends facing each other;

a plurality of coil support members extending transversely between and supported by said u-shaped channels, said support members providing vertical support for the coil mounted thereabove; and a condensate pan removably disposed between said u-shaped channels for collecting condensate falling from the coil.

2. A condensate collecting apparatus as set forth in claim 1 and including a drain line in one end of said condensate pan.

3. A condensate collecting apparatus as set forth in claim 2 wherein said drain pan includes a bottom and wherein, in the installed position, the bottom is sloped downwardly toward said drain line.

4. A condensate collecting apparatus as set forth in claim 1 wherein said pair of u-shaped channels each includes a track member disposed between its two legs, said track member being so located and disposed as to slideably receive said condensate pan thereupon.

5. A condensate collecting apparatus as set forth in claim 4 wherein said track members are sloped from the horizontal plane and said condensate pan is correspondingly tapered.

6. A condensate collecting apparatus as set forth in claim 1 and including coil sliding channels disposed between said coil support members and the coil.

* * * * *